US010578282B2

(12) United States Patent
Pendlebury

(10) Patent No.: US 10,578,282 B2
(45) Date of Patent: Mar. 3, 2020

(54) DURABLE ELECTROLUMINESCENT SIGNAGE SYSTEM AND METHOD OF MANUFACTURE

(71) Applicant: Electro-LuminX Lighting Corporation, Richmond, VA (US)

(72) Inventor: Steven Paul Pendlebury, Richmond, VA (US)

(73) Assignee: Electro-LuminX Lighting Corporation, Richmond, VA (US)

( * ) Notice: Subject to any disclaimer, the term of this patent is extended or adjusted under 35 U.S.C. 154(b) by 0 days.

(21) Appl. No.: 16/245,559

(22) Filed: Jan. 11, 2019

(65) Prior Publication Data

US 2019/0145607 A1 May 16, 2019

Related U.S. Application Data

(63) Continuation of application No. 15/587,875, filed on May 5, 2017, now Pat. No. 10,215,370.

(51) Int. Cl.

| | |
|---|---|
| ***F21V 15/01*** | (2006.01) |
| ***F21V 23/06*** | (2006.01) |
| ***F21V 19/00*** | (2006.01) |
| ***F21V 31/00*** | (2006.01) |
| ***F21S 8/00*** | (2006.01) |
| ***F21V 21/08*** | (2006.01) |
| ***G09F 9/30*** | (2006.01) |
| *F21W 111/00* | (2006.01) |
| *F21Y 105/00* | (2016.01) |
| *F21Y 115/20* | (2016.01) |
| *G09F 13/22* | (2006.01) |
| *G09F 13/04* | (2006.01) |

(52) U.S. Cl.

CPC ..... *F21V 15/01* (2013.01); *F21S 8/036* (2013.01); *F21V 19/003* (2013.01); *F21V 21/0808* (2013.01); *F21V 23/06* (2013.01); *F21V 31/005* (2013.01); *G09F 9/301* (2013.01); *F21W 2111/00* (2013.01); *F21Y 2105/00* (2013.01); *F21Y 2115/20* (2016.08); *G09F 2013/0459* (2013.01); *G09F 2013/225* (2013.01)

(58) Field of Classification Search

CPC ..... F21V 15/01; F21V 19/003; F21V 23/06; F21V 31/005

See application file for complete search history.

(56) References Cited

U.S. PATENT DOCUMENTS 4,801,928 A ‡ 1/1989 Minter ..... A62B 3/00 340/30

6,896,388 B2 ‡ 5/2005 George ..... F21S 8/032 340/33

‡ imported from a related application

*Primary Examiner* — Joseph L Williams

(74) *Attorney, Agent, or Firm* — John H. Thomas, P.C.

(57) ABSTRACT

An electroluminescent lighting system includes an electroluminescent encapsulated and protected inside a solid wall mounting channel. The mounting channel is typically plastic. The mounting channel may itself be printed on its outside display surface, or it may protect a printed surface inside its channel. The mounting channel is sealed on one end by a sealing cap and on its opposite end by an electrical connector that powers the EL lamp inside the channel. This sealed system offers a durable shield for the EL lamp that is mounted inside the channel.

11 Claims, 12 Drawing Sheets

DURABLE ELECTROLUMINESCENT SIGNAGE SYSTEM AND METHOD OF MANUFACTURE

This application is a continuation of U.S. application Ser. No. 15/587,875 filed May 5, 2017, which is incorporated by reference herein in its entirety.

The present invention is directed to a system that includes a sealed mounting channel that has an electroluminescent lamp mounted therein. A semi-rigid channel, closed at both ends, is sized and adapted to receive and encapsulate an electroluminescent light and, optionally, other films inside of the channel.

BACKGROUND

Electroluminescent lighting technology is becoming more widely embraced as an effective and efficient lighting solution in many applications. These applications include use in various household accent locations. More especially, however, electroluminescent lighting is being used in commercial and public spaces for signage and décor purposes including for example as emergency lighting. It is the nature of electroluminescent technology that it requires some protection of the systems to improve the durability and lifespan of the systems when subject to environmental elements. The lightweight and flat structure of electroluminescent systems makes them subject to wear and tear, and in public spaces especially, theft and vandalism.

Public spaces including transportation centers, train stations and vehicle tunnels present inherent lighting challenges because of their size and infrastructure limitations. The size and length of the public spaces require difficult wiring demands for their regular lighting, not just their emergency lighting. Electroluminescent lighting products have been tried in an effort to meet these problems with lighting public spaces, but the environmental stresses on these systems require protective measures. For instance, earlier styles of plastic channels have been used, but these earlier channels have a longitudinal slot in them to facilitate the insertion of an electroluminescent lamp strip therein. Vent and drain holes have been added to try to counter moisture buildup inside the protective cover. Regardless, the electroluminescent lamp strip of current systems can still be exposed to environmental elements.

SUMMARY

Accordingly, it is an object of the present invention to overcome the foregoing drawbacks of existing electroluminescent installations by providing an encapsulated channel in which the EL lamp is protected from environmental elements.

In one example, an electroluminescent lighting system comprises a sealed mounting channel sized to receive therein an electroluminescent lamp. An electroluminescent lamp is positioned in the mounting channel, and wherein the electroluminescent lamp comprises a lighted side that is itself adjacent a display side of the mounting channel. The mounting channel has a first end and a second end, wherein the first end has a sealing cap connected to the end of the channel and sealing the first end of the mounting channel and the second end of the mounting channel has an electrical connector insert that extends into the inside of the mounting channel and is electrically connected to and powers the electroluminescent lamp, and further wherein the electrical connector is sealed to the second end of the mounting channel. The display side of the mounting channel may be formed of a substantially transparent material or alternatively a substantially translucent material. The display side of the mounting channel may have an inside face that is inside the mounting channel and an outside face on the opposite side of the display side, and wherein the display side has indicia printed on the outside face thereof. The indicia may be translucent or opaque or tinted or black. The indicia may be adhered to the outside face of the display side of the mounting channel. The mounting channel may be formed of a material selected from the group consisting of polycarbonate, polyester, polyethylene, polypropylene, polyvinyl chloride and fiberglass.

In another example, a method of mounting an electroluminescent lamp inside a mounting channel comprising several steps. The steps include providing a sealed mounting channel sized to receive therein an electroluminescent lamp and an electroluminescent lamp sized to be able to be positioned in the mounting channel, wherein the mounting channel has a first end and a second end, and further wherein the electroluminescent lamp has a first end and a second end; providing continuous leader placed within the mounting channel; attaching one end of the leader to the first end of the electroluminescent lamp; pulling the electroluminescent lamp into and through the mounting channel; providing a sealing cap, and fixing the sealing cap onto the first end of the mounting channel; providing an electrical connector, and attaching the electrical connector to the second end of the electroluminescent lamp to power the electroluminescent lamp; and sealing the electrical connector to the second end of the mounting channel, whereby an electroluminescent lamp is sealed inside the mounting channel.

In a still further embodiment, a kit for use in mounting an electroluminescent lamp inside a mounting channel comprises a sealed mounting channel sized to receive therein an electroluminescent lamp and an electroluminescent lamp sized to be able to be positioned in the mounting channel, wherein the mounting channel has a first end and a second end, and further wherein the electroluminescent lamp has a first end and a second end. The kit also includes a continuous leader placed within the mounting channel, a sealing cap adapted to be fixed onto the first end of the mounting channel, and an electrical connector adapted to be attached to the second end of the electroluminescent lamp to power the electroluminescent lamp, whereby an electroluminescent lamp may be sealed inside the mounting channel.

BRIEF DESCRIPTION OF THE DRAWINGS

FIG. 7A is a top view of a plastic channel with adhesive foam tape on the back side of the plastic channel. FIG. 7B illustrates the plastic channel with adhesive foam tape being applied to a surface. FIG. 7C is a back view of the plastic channel with the adhesive foam tape on the back side surface.

FIG. 9A illustrates a base layer of a system. Figure (b illustrates a base layer with an EL lamp mounted thereon. FIG. 9C is an exploded view of the complete system with the encapsulated EL lamp and an image layer mounted over it. FIG. 9D is a top, crossectional view of the assembled EL system.

DETAILED DESCRIPTION

Figure 1:
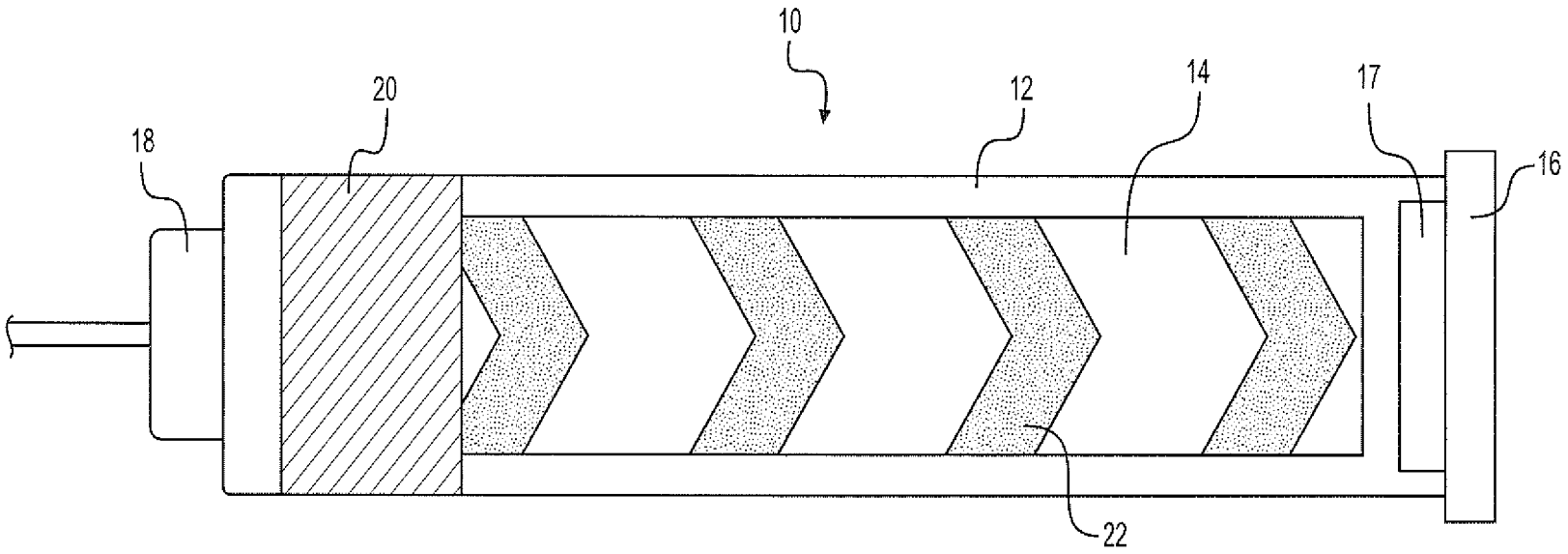
FIG. 1 is a perspective view of an assembled electroluminescent lighting system as described herein.

The system described herein is designed to provide a protective housing for electroluminescent lighting (EL) tape or sheets (collectively an EL lamp). While the EL lamp is generally built with a plastic outer layer that encapsulates the EL material that lights up once electrical current is applied to it, this EL outer layer is essential to maintain intact in order to ensure the operation of the EL lamp. Moreover, it is sometimes desirable that indicia may be desired to be highlighted by the EL lamp. Accordingly, a protective, mounting channel is described herein that may be used to protect an EL lamp and also protect indicia that may be highlighted by the EL lamp.

The protective channel, also alternatively referred to as a mounting channel, may itself have many sizes. Basically, it is a hollow, sealed tube that will encapsulate and protect the EL lamp positioned therein. The mounting channel may be formed of a solid-walled, hard plastic material. Alternatively, the channel may be a flexible plastic material that is sealed to encapsulate and protect the EL lamp positioned inside of it. The mounting channel is typically formed of either hard or flexible plastic and may be further referred to as a plastic channel. Its thickness and composition is a function of the channel material used, but generally speaking, the channel is fairly flat so as to support the EL lamp that is positioned inside of it. The width of the channel may be from about 0.25 to 60 inches, or alternatively, about 0.5 to twelve inches, or still further alternatively, about one to six inches. This width of the plastic channel may correspond to the width of the EL lamp positioned inside, with the width of the plastic mounting channel and the hollow space inside the mounting channel being at least slightly larger than the width of the EL lamp. The length of the mounting channel may be as short as a few inches up to hundreds of feet. The length limitation is only the size of the EL lamp and the distance from an electrical power source. In one example, a lighted sign along a wall in a public transit tunnel may be about 2.5 inches wide and about one hundred feet long. Alternatively, the length of the mounting channel may be at least 25 feet long, or further alternatively, at least 50 feet long, or still further alternatively at least one hundred feet long. Finally, the dimensions of the hollow space inside the plastic channel may be designed to be slightly more than the thickness of the EL lamp and any supplemental film layers that may also be laminated to the EL lamp or otherwise separately drawn into the hollow space in the plastic channel. Another factor is the expected contraction and expansion of the EL lamp in the hollow space. Either extra space may be allowed for in the mounting channel, or the channel can be formed of a flexible material. The seal that protects the EL lamp may have a viscoelastic material that allows for the expansion of the EL lamp. Still further, the plastic material that forms the channel may be selected based on its own material expansions and contractions. In practice, this hollow space has a width dimension slightly larger than the width of the EL lamp, or about a half inch up to about 60 inches, or alternatively about 2 inches to 24 inches, or further alternatively about 3 inches to 12 inches. The thickness of the cavity or hollow space may be the same size and the dimensions of the EL lamp, or the thickness may be from one or two millimeters to some fractions of an inch in order to allow an EL lamp to slide into and through the channel.

The mounting channel can be formed of different materials. Functionally, this channel is intended to offer protection of the EL lamp positioned inside of it. The protection is both from environmental conditions as well as human abuse. For instance, the material may be selected from the group consisting of polycarbonate, polyester, polyethylene, polypropylene, polyvinyl chloride and fiberglass and blends thereof. Polycarbonate is a very tough and semi-rigid plastic that could be used, for example, on a vertical wall application. Alternatively, a relatively more thin polyvinyl chloride film may be used to encapsulate and protect an EL lamp in a horizontal application such as on a floor or ground surface. In another instance, the EL lamp needs to curve, and in this case, the EL lamp tape may be laid flat, and then lay two layers of plastic, for instance polyvinyl chloride or other flexible plastic films, are then sonic welded or alternatively laminated around the EL lamp which will join the two vinyl layers together to form an envelope, which could form a channel of laminated walls with all the same protective benefits and properties, but in a non-linear shape.

The mounting channel material can be substantially transparent or some degree of translucent. Different visual effects are possible depending on the material selected. For instance a sharp and bright effect may be accomplished with a transparent channel material while a muted glowing effect can be achieved with a translucent material. The material may also be tinted in whole or in part, again, for an intended effect or purpose. The tinted colors could be anything including yellow or red or blue or green, among all other colors. If colored, the color may be transparent, translucent or opaque in various patterns or indicia. The tint may be incorporated into the plastic channel material or may be layered or printed on the outside of the channel. Informational indicia may be printed on the outside of the channel, for instance exit arrows in a large room or hallway. Marketing or advertising indicia may also be printed thereon, for instance advertising food and beverage or other products.

The mounting channel has a front, display side that is positioned next to a lighted side of the EL lamp. It would be expected that this display side of the mounting channel is the primary visible side of the mounting channel. This display side is printed with indicia and/or tinted for effect as discussed above. Therefore, it is expected that the mounting channel may have different tinting treatment or printed indicia with respect to the display and back sides of the mounting channel.

A sealing cap is sized to fit inside and or around the end of its paired protective plastic channel. This cap is used to securely seal the EL lamp into the space inside the channel on one end. Different adhesives may be optionally used to complete the seal, or alternatively a good friction fit may also serve the sealing purpose. This sealing cap may be selected and sized to form an air and moisture impermeable seal in some environmental placements where the EL system may be mounted that are particularly destructive to the EL lamp including, for instance, wet, humid or salt water applications. Otherwise, the sealing cap seal may be intentionally permeable or porous. It is especially envisioned that the sealing cap may be porous only one way, that is allowing moisture to drain or escape from inside the cavity, but not allow moisture into the cavity. An alternative to a sealing cap would be direct sealing together of the sides of the mounting channel. In the alternative of a channel formed from a relatively flexible film material, a flexible adhesive or a conventional heat or sonic weld could be used to create the sealed channel.

An electrical connector that is attached to one end of the EL lamp to power the lamp may be a conventional connector structure. This connector would then be optionally wrapped with a plastic sleeve like a heat shrink sleeve to seal that opposite end of the channel that has an end cap on it. Alternatively, however, the electrical connector can be sized to provide a friction fit seal with one end of the channel. There may be a small flange formed around a perimeter of the connector to correspond to the opening of the inside hollow space on the end of the channel. As with the sealing cap, this seal may be impermeable to water, air and humidity, or it may be intentionally permeable and porous depending on the mounting environment conditions.

As already discussed, visual indicia may be printed onto the outside, display face of the protective plastic channel. Alternatively, indicia may be adhered to or printed onto the outside surface of the EL lamp. This way, when the EL lamp inside the channel is lit, then the indicia may be highlighted. One example would be arrows along a long EL tape that guides persons to a safe exit. Another example might be a commercial purpose to advertise products or services that are highlighted. A still further way to place indicia in front of the EL lamp is to position a separate tinted or printed film inside the hollow space of the plastic channel and in front of the EL lamp.

It has been determined that pairing specific tints with specific EL lamp output wavelengths, that distinctive highlight effects are obtained. As is widely known, only certain colors/wavelengths are available to be transmitted by EL lamps. These include blue, green, blue green, orange, and red with a wavelength between 400 and 600 nanometers, however, the phosphor color is not always the 'shade' of color that a customer would like, thus it is important to saturate the phosphor with another layer of desired color. Therefore, in order to obtain alternative colors, tinted layers must be placed on the outside of the EL lamp. As explained earlier, these tints may be 1) printed on the EL lamp surface itself, 2) incorporated into a thin plastic layer that is laminated to the outside of the EL lamp, 3) as a separate film that is positioned in the plastic channel outside the visible, display side of the EL lamp, 4) incorporated into the plastic material that forms the protective plastic channel, or 5) printed onto the outside face of the display side of the protective plastic channel in front of the EL lamp. Examples of specific EL lamp colors and tinting may include a salmon 'colored' filter for producing differing white light color temperatures. Also, materials may be imbedded in or coated onto the surface of the filter to produce reflective or special surface properties such as sparkles, or oversaturation colors which cover the ROYGBIV spectrum. Still further alternatively, other films may magnify light brightness, for instance fluorescent films or optical brighteners.

Still further, distinctive highlight effects may be achieved by matching particular EL lamps with specially chosen tint layers, such as fluorescent films. By the use of active filtration, it is possible to block or adsorb certain wave lengths or frequencies of light, allowing just the preferred spectrum of light to become visible. This method is useful in changing light into new colors or shades of colors. It is possible to envision extruding a plastic mounting channel around a particular EL lamp, but this method of positioning the EL lamp in the channel does not make it easy to adjust or quickly vary the size or length, for instance, of an EL system. Moreover, some applications might be long and relatively thin as in the example of exit arrows in a public space. Over an extremely short distance, it might be possible to physically push an EL lamp through a channel. A better method, however, is to position a leader inside the mounting channel during the extrusion of the plastic channel. The leader is simply a continuous string or tape that is run the length of the mounting channel. In operation, one end of the leader may be tied or otherwise connected to the leading edge of an EL lamp. Then, the opposite end of the tape at the opposite end of the mounting channel is pulled through the channel and thereby draws the EL lamp into and through the length of the channel. This way, an installer of the EL system can cut a piece of mounting channel to a desired length. Then a long roll of EL lamp is attached at one end and exactly the length of EL lamp needed is drawn through that mounting channel. It is surely recognized that on-site installations often include dimension variations. This flexible method of installing exactly what is required in a mounting channel is very efficient.

Turning now to the drawings, FIGS. 1-4 illustrate an example of an electroluminescent system where an electroluminescent lamp tape is inserted into a protective plastic mounting channel. Specifically, the EL lighting system 10 includes a plastic mounting channel 12 with an EL lamp 14 positioned inside of it. On one end of the mounting channel 12 there is an end sealing cap 16 that prevents moisture or other environmental air from entering the inside of the channel where the EL lamp 14 is placed. In this example shown, the end sealing cap 16 includes a tab portion 17 that is inserted into the inside of the mounting channel 12 to help secure the sealing cap to the channel. The fit between the sealing cap 16 and the channel 12 may be a secure friction fit, or it may include some adhesive or other fastening material.

Figure 4:
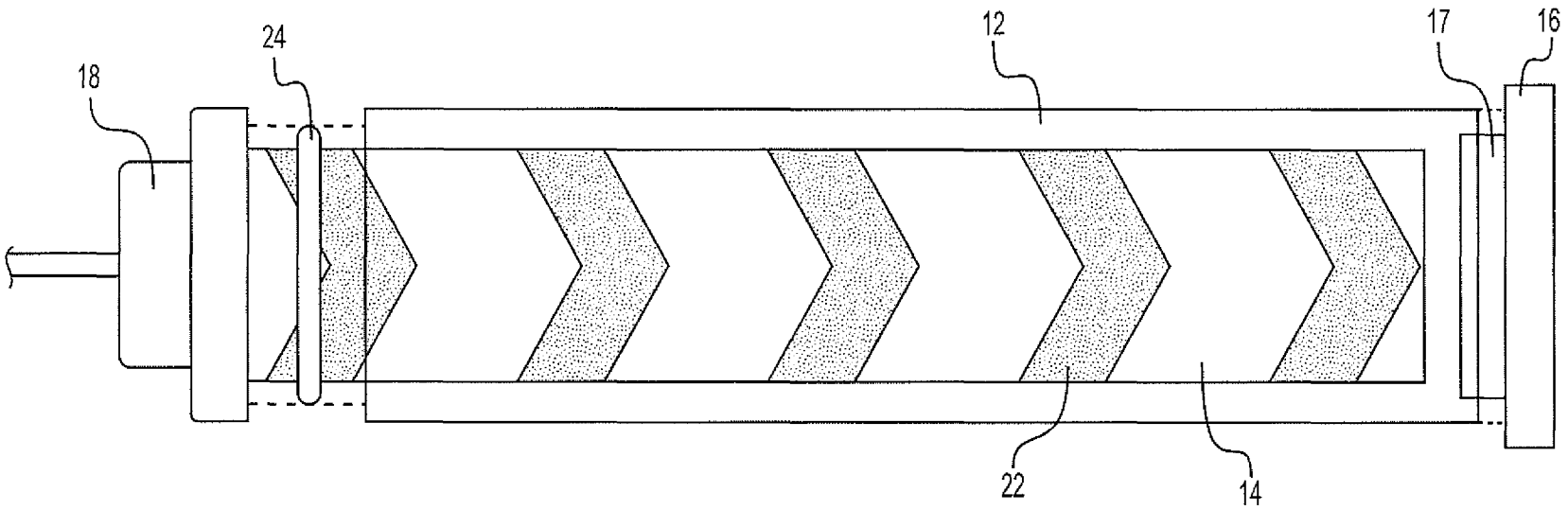
FIG. 4 is an exploded perspective view of a plastic channel with the EL tape positioned inside the channel and the end cap and electrical connector on opposite ends of the channel.
Figure 5:
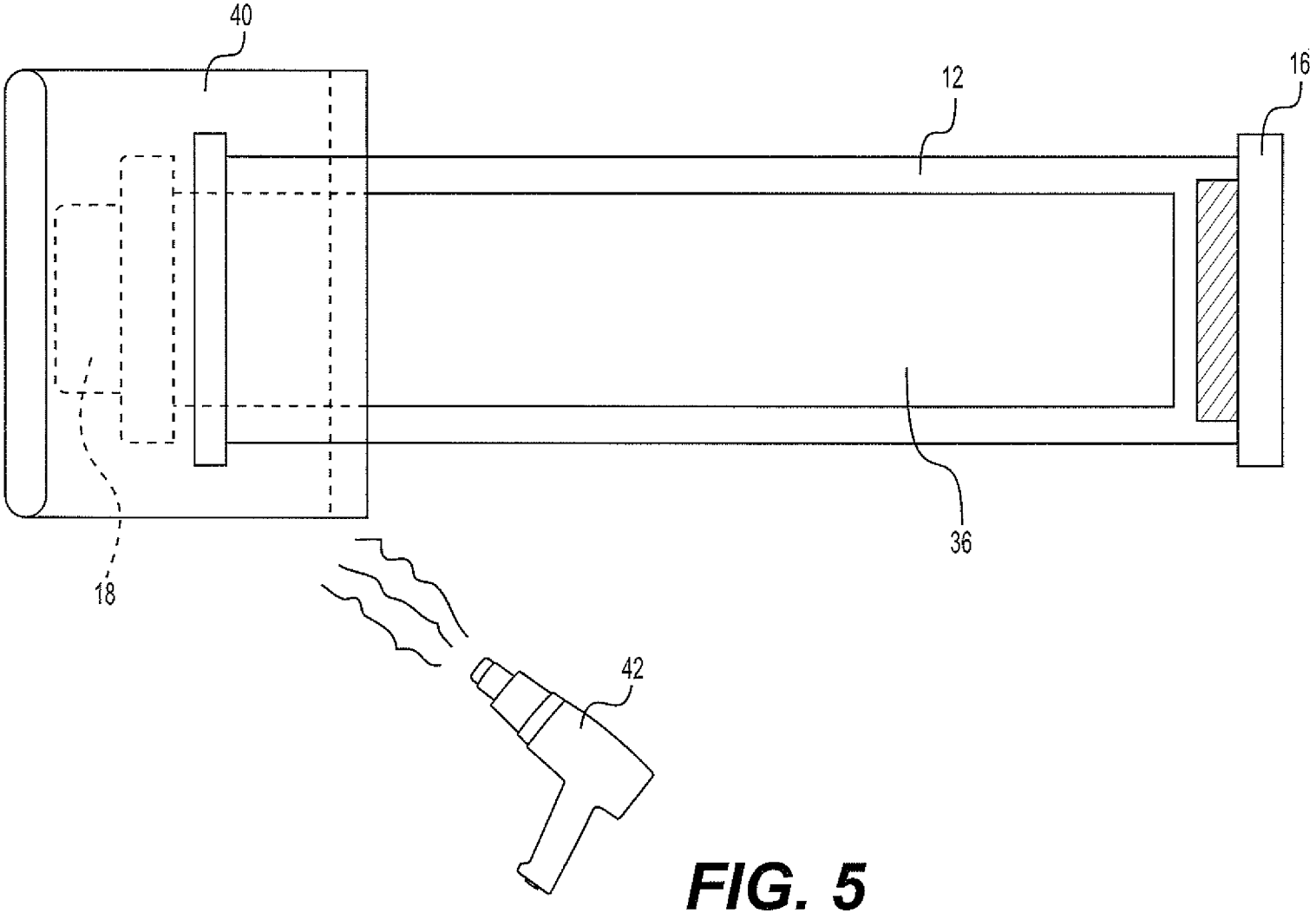
FIG. 5 is a perspective view of an assembled channel with a shrink tube positioned around the electrical connector end that illustrates how the connector is attached to the EL tape and the plastic channel.

On the opposite end of the mounting channel 12 from the sealing cap 16 there is an electrical connector 18 that is connected to the EL lamp 14 and feeds power to that lamp. As shown in FIG. 1, a sealing adhesive tape 20 is wrapped around the channel 12 and electrical connector 18 and seals and connects the electrical connector to the end of the channel. Alternatively, in FIG. 4 a soft plastic water seal ring 24 is used to attach and seal the electrical connector 18 to the end of the mount channel 12. Still further alternatively, FIG. 5 illustrates the use of a heat shrink wrap 40 to connect the electrical connector 18 to the end of the channel 12. The heat shrink seal 40 is heated with any sort of heat gun 42 to shrink and seal the wrap.

In FIGS. 1-4, the EL lamp 14 is shown with direction arrow indicia 22 on the face thereof. In this example, the EL system might be mounted in a hallway or public room and the arrow indicia 22 may direct persons out of or along an intended path in a room or hall. There is no restriction as to what the indicia might be. As discussed earlier, the indicia may be directional or safety-related as shown in the figures. Alternatively, marketing or advertising indicial might be printed on the EL lamp face. In FIG. 5, the EL lamp 36 is blank or tinted with no specific indicia printed on it.

Figure 2:
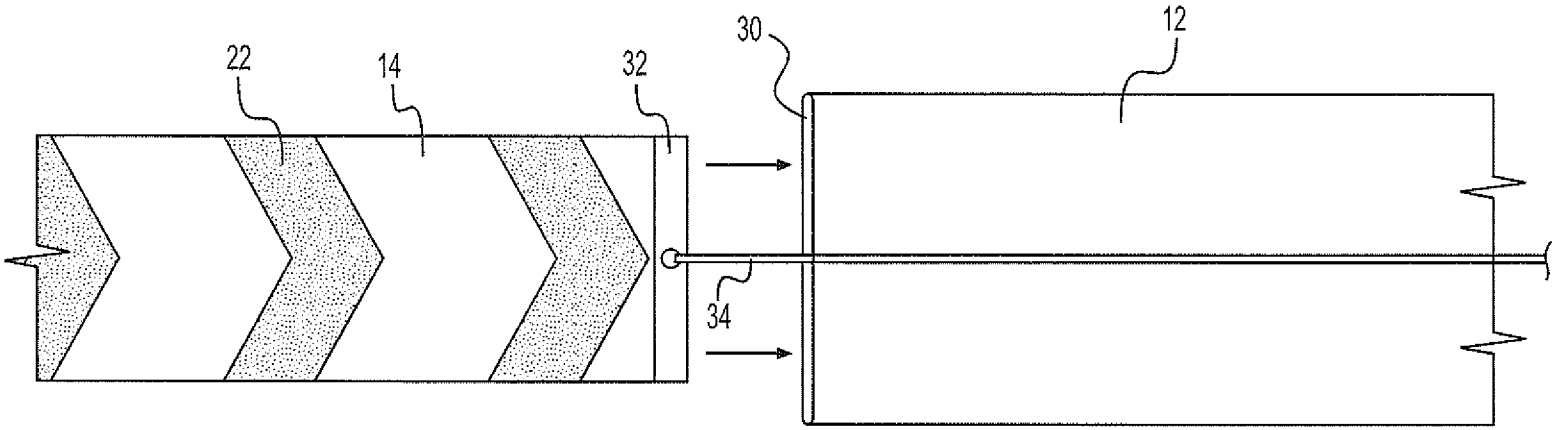
FIG. 2 is a perspective view of a plastic channel with a leader positioned therein and connected to an end of electroluminescent light tape to demonstrate how the EL tape is drawn into the plastic channel.
Figure 3:
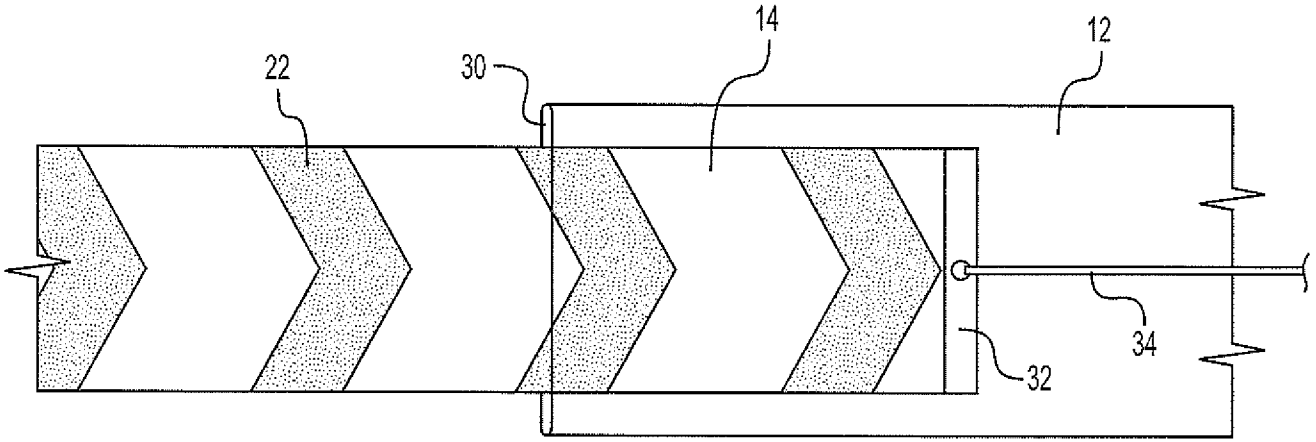
FIG. 3 is a perspective view of a plastic channel with a leader positioned therein and connected to the end of EL tape with the EL tape partially drawn into the channel.

In FIG. 1, the EL lamp 14 is shown all assembled and encapsulated in the mounting channel 12. FIGS. 2-4 illustrate a way of positioning the EL lamp 14 into the inside of the channel 12. In FIG. 2, a leader 34 is shown positioned inside the cavity 30 of the channel 12. The leader 34 may be any string or cord. The leader 34 is placed inside the cavity 30 during the process of forming the channel 12. The leader 34 is contained and continuous along the entire length of the channel 12. As illustrated in FIGS. 2 and 3, the leader 34 is tied or otherwise attached to a front end 32 of the EL lamp 14. By pulling on the opposite end of the leader 34, the EL lamp 14 is drawn into the cavity 30 of the channel 12. In this way, the EL lamp 14 can be positioned inside the entire length of the channel 12. Once fully in place, the leader 34 can be removed, the end sealing cap 16 installed on one end, and the electrical connector 18 attached to the opposite end, and then the system 10 is ready to install.

Figure 6A:
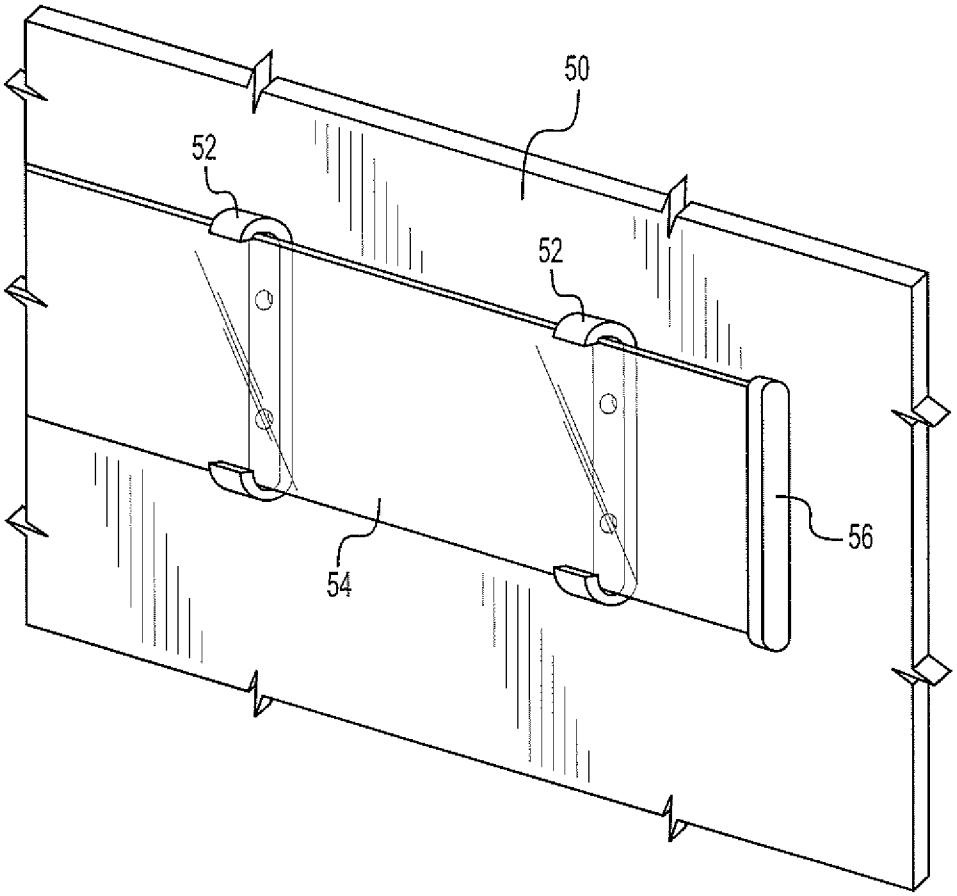
FIGS. 6A and 6B are a perspective view (FIG. 6A) and an exploded perspective view (FIG. 6B) demonstrating one way of mounting the plastic channel on wall clips.
Figure 6B:
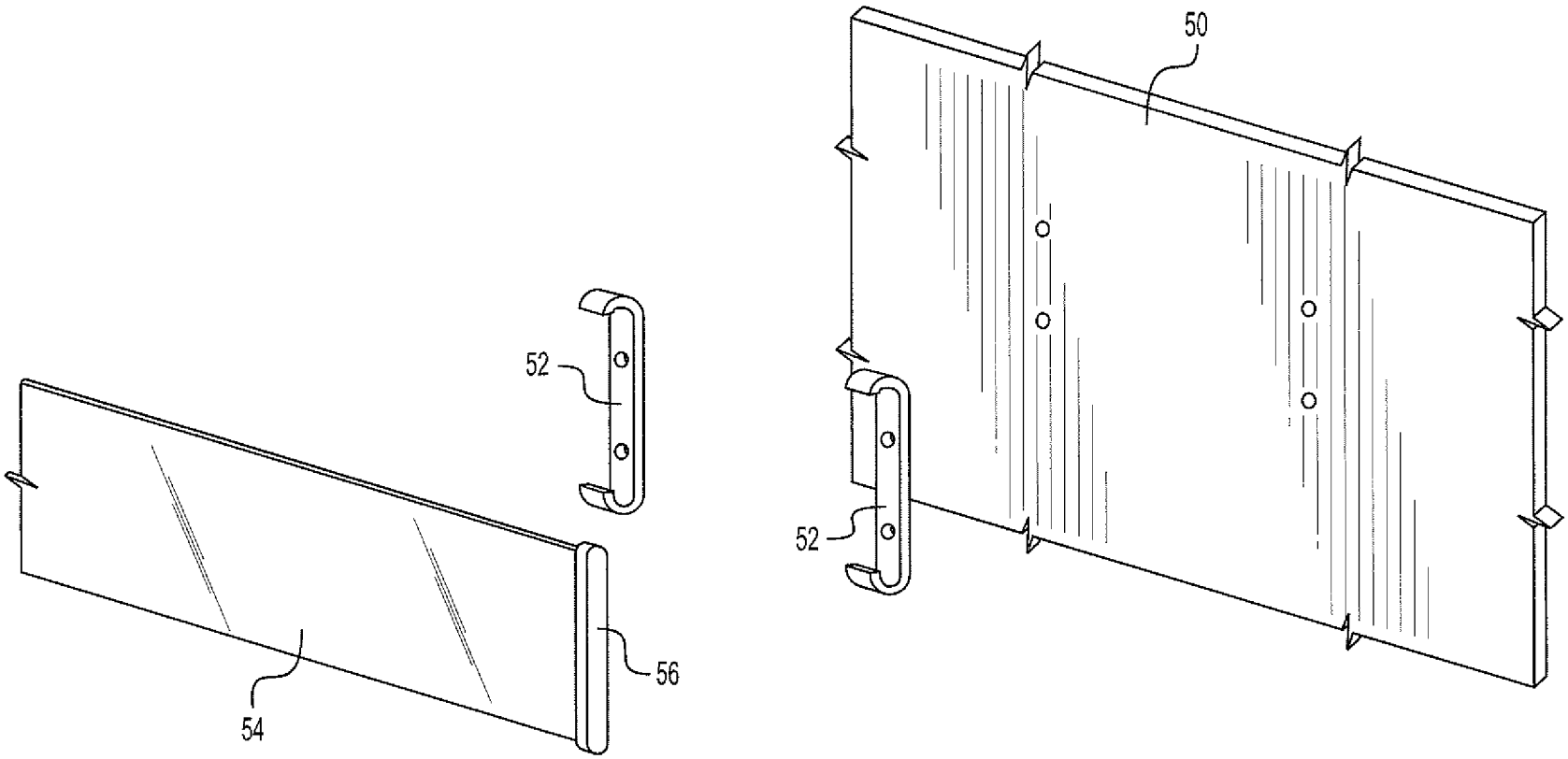

FIGS. 6A and 6B illustrate one method of mounting the EL system channel 54 onto C-clips 52. The C-clips 52 are screwed or otherwise fastened onto a surface 50 such as a wall. The C-clips are one example of a physical bracket that may be used to secure a channel 54 to a surface. Other types and shapes of physical brackets may alternatively be used.

Figure 7A:
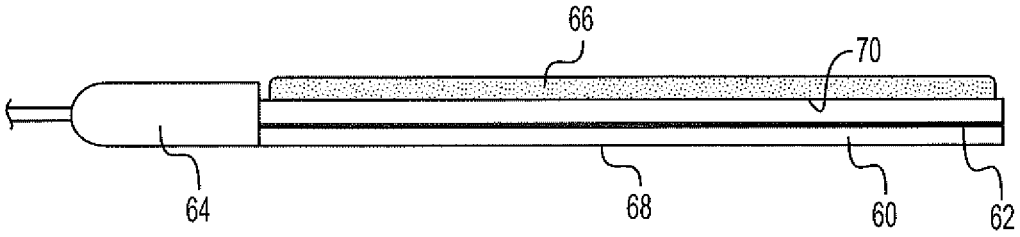
FIGS. 7A-C illustrate another way to mount a plastic channel on a surface.
Figure 7B:
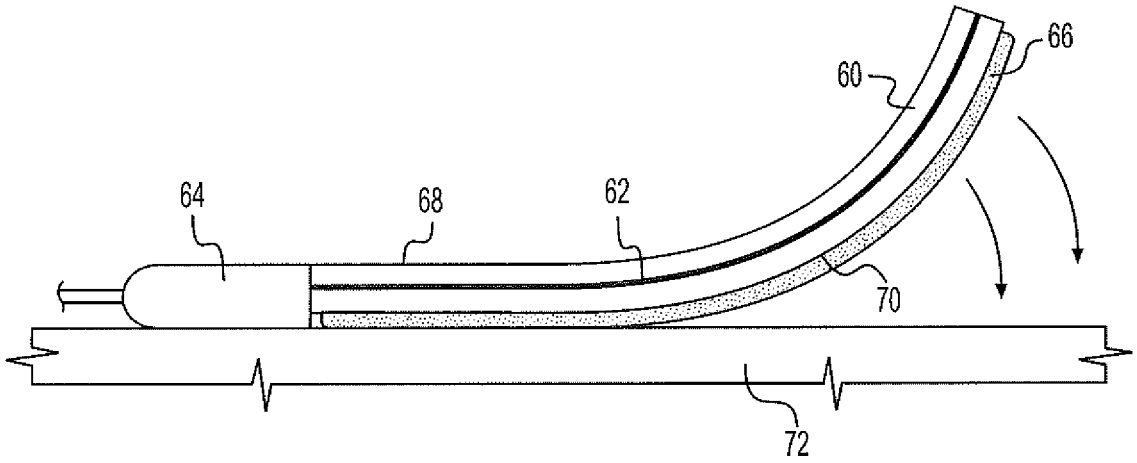
Figure 7C:
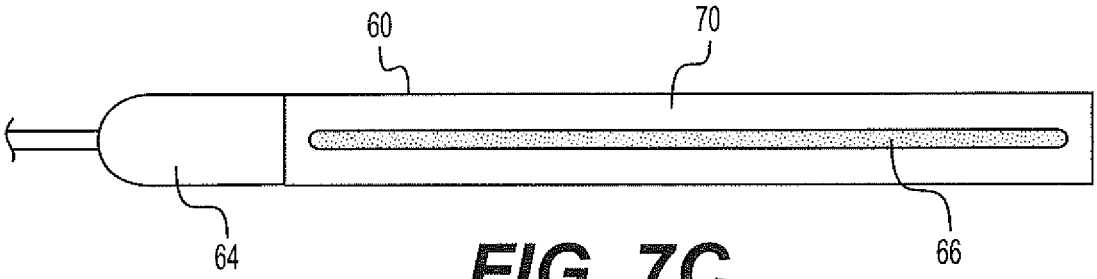

In FIGS. 7A-7C, an alternative mounting structure is shown. A mounting channel 60 is formed of a flexible plastic material. Inside the channel 60 is an EL lamp 62. An electrical connector 64 is shown fixed on an end of the channel 60. The channel 60 has a front, display side 68 and a back side 70. Attached to the back side 70 is a foam adhesive tape 66 that is impregnated with a durable and aggressive pressure sensitive adhesive that is adapted to support and fix the channel 70 on most surfaces. Recognizing the anticipated expansion and contraction of a channel material in changing environmental conditions, the adhesive may be a viscoelastic material that is engineered to expand and contract with the channel while still maintaining a good adhesion to the surface where the channel is mounted. FIG. 7B shows the mounting of the channel 60 onto a surface 72. This surface 72 may be a flat surface on a floor or ceiling or may be a flat vertical surface. Because of the nature of the flexible plastic channel 60, the surface may alternatively be curved or uneven.

Figure 8A:
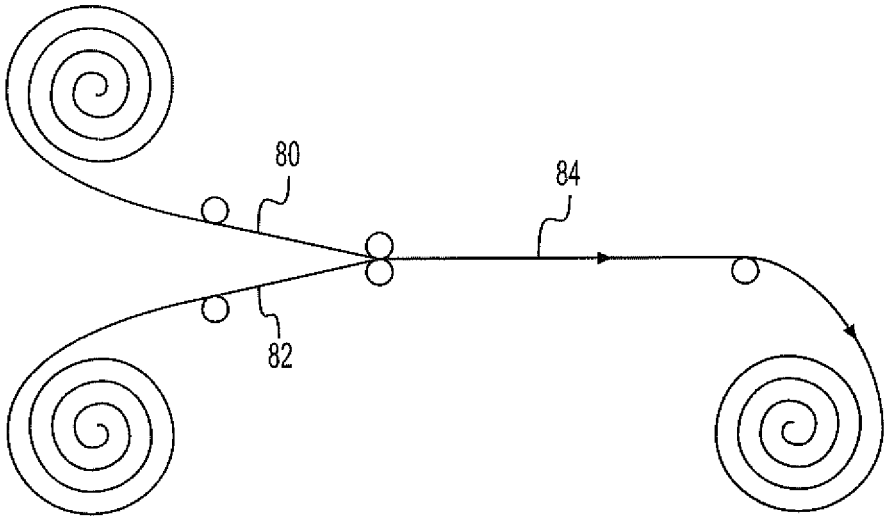
FIGS. 8A and 8B illustrate a method for applying a print film layer to the surface of an EL tape and then sealing the EL tape with overlamination layers.
Figure 8B:
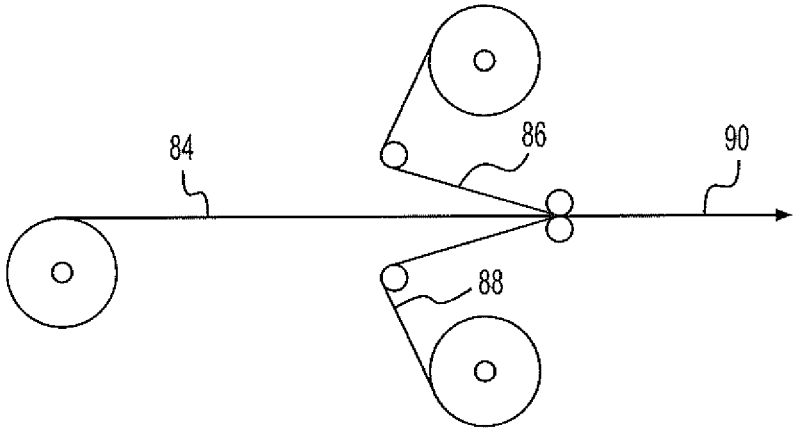

FIGS. 8A and 8B illustrate one way that an EL lamp may be printed or sheathed or tinted before insertion into a mounting channel. FIG. 8A displays a flexible EL lamp 80 that is laminated to a coating or film 82 to form a two-layer lamp with coating. The film 82 may have printed indicia thereon or may be tinted for a specific purpose. The film 82 is applied onto the display side of the EL lamp 80. This coated EL lamp 84 may itself be positioned into the cavity of a flexible or rigid channel. Alternatively, this coated EL lamp 84, as shown in FIG. 8B, may be subsequently be laminated between protective plastic film layers 86 and 88. These film layers 86 and 88 might be the same, for instance PVC, or they might be different. The front, display side of the coated EL lamp 84 may have a film 86 or 88 that is tinted or printed with indicia. This further laminated EL lamp 90 may then be positioned inside the mounting channel.

FIGS. 1-6 illustrated a preformed, sealed channel that may be formed of rigid or flexible, solid-walled plastic. The lamination process illustrated in FIGS. 8A and B demonstrates that an overlamination pair of films may be placed over and encapsulate an EL lamp inside. The front and back overlamination layers, similar to layers 86 and 88 in FIG. 8B, can be adhered or heat welded or sonic welded together around the EL lamp inside those layers. Particularly when using flexible films, the result is a protected EL lamp that may find application in uneven mountings and mountings around curves and corners. The flexible channel material may expand and contract with the EL lamp under different environmental conditions.

Figure 9B:
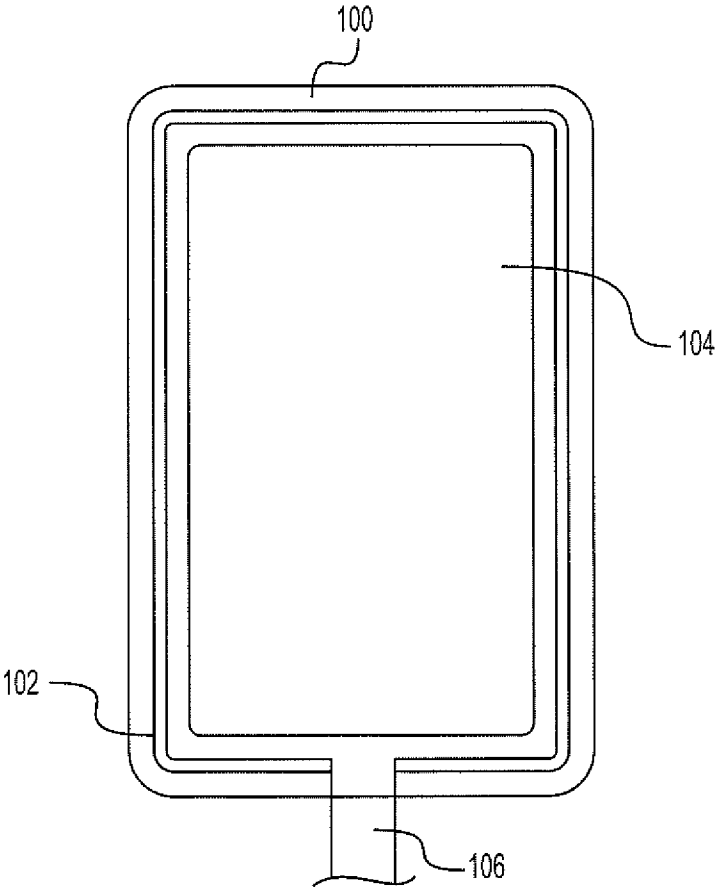
FIGS. 9A-9D illustrate the layers of an alternative method of encapsulating an EL sign in a plastic cover.
Figure 9A:
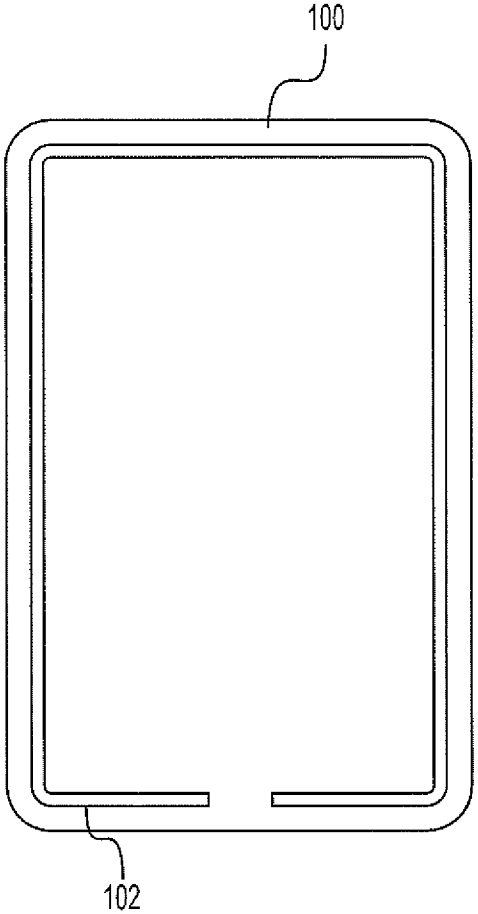
Figure 9C:
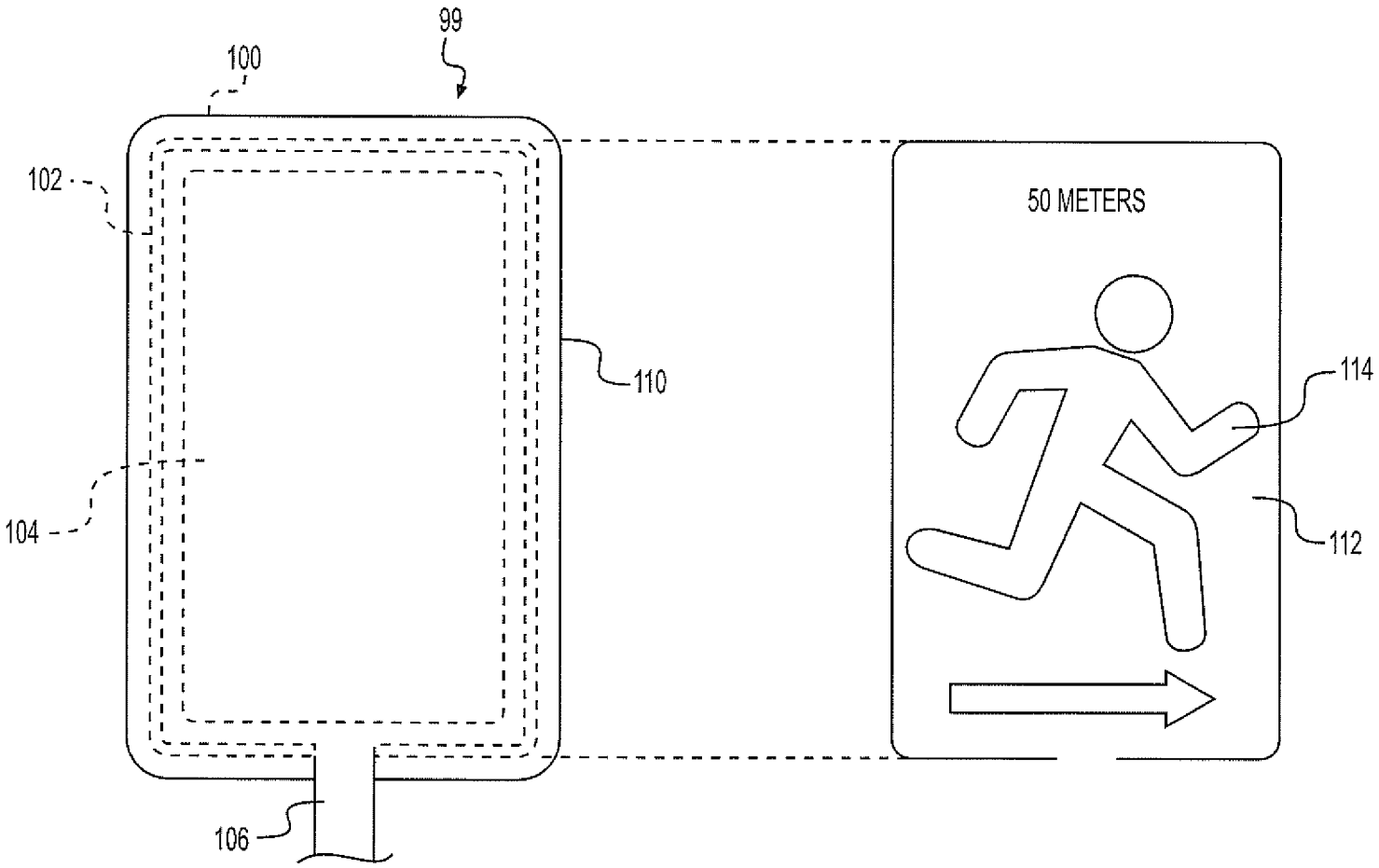
Figure 9D:
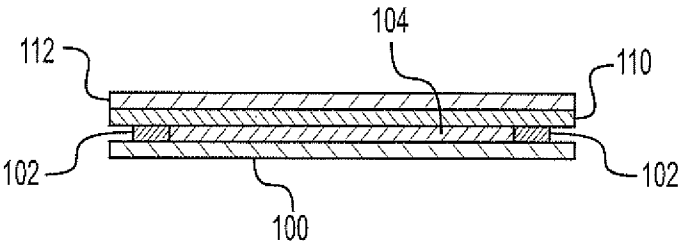

FIGS. 9A-9D illustrate a sign 99 that includes an EL lamp 104 captured in a sealed system. FIG. 9A is a front view of the base layer 100 of the sign 99 with a seal 102 around the perimeter of the base layer. In FIG. 9B, an EL lamp 104 is placed on the base layer 100 and inside the seal 102. An electrical connector 106 is connected to and powers the EL lamp 104 with the connector being positioned within a gap in the seal 102. In FIG. 9C, a protective front layer 110 is placed on and covers the EL lamp 104 and is adhered to the base layer 100 by the seal 102. The front layer 110 is a transparent or translucent film that is also tough and rugged enough to protect and encapsulate the EL lamp 104. This front layer 110 may also be tinted to modulate or change the color of the projected light from the EL lamp 104. A sign layer 112 is placed on top of the protected front layer 110 to form a further 'sandwich' with the front layer which has a signage or symbol pattern 114 on its surface. The outside sign layer 112 provides delineation and forms the final message or indicia 114 that an observer, in this example of a walking man, a pedestrian would see. The indicia 14 may be outlined in an opaque color, for instance black, to block out and display a message or information. Alternatively, the indicia 114 may be outlined in a translucent color. Still further, the indicia itself may be defined in an opaque shape with the message being delivered by the lighting around the indicia. The sign layer 112 may be positioned onto the front layer 110 by a lamination onto that layer or by adhesive around the perimeter of the sign layer 112 or by some mechanical attachment. The complete assembled sign 99 is traditionally mounted using mechanical vandal resistant fasteners.

A sign like sign 99 in FIGS. 9A-9D is similar in construction to the mounting channel discussed earlier herein. The EL lamp is encapsulated in a plastic channel or envelope. The sealed position not only protects the EL lamp inside, it also allows indicia to be printed onto an outside film layer as shown or alternatively onto the surface of the EL lamp or another layer laminated onto the EL lamp before sealing into the protective envelope. All of the variations with respect to indicia and tinting discussed earlier are also applicable to a sign.

While the invention has been described with reference to specific embodiments thereof, it will be understood that numerous variations, modifications and additional embodiments are possible, and all such variations, modifications, and embodiments are to be regarded as being within the spirit and scope of the invention.

That which is claimed is:

1. An electroluminescent lighting system comprising:

a sealed mounting channel sized to receive therein an electroluminescent lamp, wherein the channel is formed between a base layer and a protective front layer and a seal around a perimeter between the base layer and front layer;

an electroluminescent lamp positioned in the mounting channel, and wherein the electroluminescent lamp comprises a lighted side that is itself adjacent the front layer of the mounting channel;

the mounting channel having a gap in the seal and an electrical connector insert that extends into the inside of the mounting channel and is electrically connected to and powers the electroluminescent lamp, and wherein the electrical connector is sealed to the gap in the seal.

2. The electroluminescent lighting system described in claim 1, wherein the front layer of the mounting channel is formed of a substantially transparent material.

3. The electroluminescent lighting system described in claim 1, wherein the front layer of the mounting channel is formed of a substantially translucent material.

4. The electroluminescent lighting system described in claim 1, wherein the front layer of the mounting channel has an inside face that is inside the mounting channel and an outside face on the opposite side of the front layer, and wherein the front layer has indicia printed on the outside face thereof.

5. The electroluminescent lighting system described in claim 1, wherein the indicia is translucent.

6. The electroluminescent lighting system described in claim 1, wherein the indicia is opaque.

7. The electroluminescent lighting system described in claim 1, wherein the indicia is tinted.

8. The electroluminescent lighting system described in claim 1, wherein the indicia is black.

9. The electroluminescent lighting system described in claim 1, wherein the front layer of the mounting channel has an inside face that is inside the mounting channel and an outside face on the opposite side of the front layer, and wherein the front layer has indicia adhered to the outside face thereof.

10. The electroluminescent lighting system described in claim 1, wherein the front layer of the mounting channel is formed of a material selected from the group consisting of polycarbonate, polyester, polyethylene, polypropylene, polyvinyl chloride and fiberglass and blends thereof.

11. The electroluminescent lighting system described in claim 1, wherein the front layer of the mounting channel is formed of a polycarbonate material.

* * * * *